US011624154B2

(12) United States Patent
Chen et al.

(10) Patent No.: US 11,624,154 B2
(45) Date of Patent: *Apr. 11, 2023

(54) METHOD FOR PREPARING UNBLEACHED BIOMECHANICAL PULP FROM STRAW

(71) Applicant: QILU UNIVERSITY OF TECHNOLOGY, Shandong (CN)

(72) Inventors: Jiachuan Chen, Jinan (CN); Xingxiang Ji, Jinan (CN); Guihua Yang, Jinan (CN); Zhongjian Tian, Jinan (CN); Ruiming Wang, Jinan (CN); Yuqian Guo, Jinan (CN)

(73) Assignee: QILU UNIVERSITY OF TECHNOLOGY, Jinan (CN)

( * ) Notice: Subject to any disclaimer, the term of this patent is extended or adjusted under 35 U.S.C. 154(b) by 255 days.

This patent is subject to a terminal disclaimer.

(21) Appl. No.: 16/954,275

(22) PCT Filed: Apr. 29, 2019

(86) PCT No.: PCT/CN2019/084971

§ 371 (c)(1),
(2) Date: Jun. 16, 2020

(87) PCT Pub. No.: WO2020/133857

PCT Pub. Date: Jul. 2, 2020

(65) Prior Publication Data

US 2021/0054566 A1 Feb. 25, 2021

(30) Foreign Application Priority Data

Apr. 29, 2019 (CN) ..... 201811645480.1

(51) Int. Cl.

| | |
|---|---|
| ***D21H 11/12*** | (2006.01) |
| ***D21B 1/16*** | (2006.01) |
| ***D21C 1/02*** | (2006.01) |
| ***D21C 1/06*** | (2006.01) |
| ***D21C 5/00*** | (2006.01) |

(52) U.S. Cl.

CPC ..... *D21H 11/12* (2013.01); *D21B 1/16* (2013.01); *D21C 1/02* (2013.01); *D21C 1/06* (2013.01); *D21C 5/005* (2013.01)

(58) Field of Classification Search

CPC . D21H 11/12; D21B 1/16; D21C 1/02; D21C 1/06; D21C 5/005

See application file for complete search history.

(56) References Cited

U.S. PATENT DOCUMENTS

2005/0241785 A1 11/2005 Peng et al.
2011/0061825 A1* 3/2011 Li ..... D21C 5/00 162/13

FOREIGN PATENT DOCUMENTS

| | | | |
|---|---|---|---|
| CN | 1681992 | A | 10/2005 |
| CN | 103243597 | A | 8/2013 |
| CN | 103555702 | A | 2/2014 |
| CN | 107513875 | A | 12/2017 |
| CN | 108978305 | A | 12/2018 |
| CN | 109577059 | A | 4/2019 |

OTHER PUBLICATIONS

Nov. 12, 2019 Chinese Search Report issued in Chinese Patent Application No. 2018116454801.
Aug. 30, 2019 International Search Report issued in Internaitonal Patent Application No. PCT/CN2019/084971.
Aug. 30, 2019 Written Opinion of the International Searching Authority issued in Internaitonal Patent Applicaiton No. PCT/CN2019/084971.
Nov. 22, 2019 Chinese Office Action issued in Chinese Patent Application No. 2018116454801.
"Study on the Biological High Yield Pulp of Mulberry Branch with Stronger Penetrative Thermostable and Alkaline Tolerant Xylanase Complex Pretreatment".

* cited by examiner

*Primary Examiner* — Anthony Calandra
(74) *Attorney, Agent, or Firm* — Oliff PLC

(57) ABSTRACT

A method for preparing unbleached biomechanical pulp from straw. A straw is used as a raw material, which is treated with alkaline biological enzymes, heated with hot alkali steam, refined, and washed. The mechanical pulp prepared by the method of the present invention has significantly improved ring-crush strength, can be used to prepare corrugated paper or cardboard paper, and can significantly improve the compressive strength of the carton.

8 Claims, No Drawings

METHOD FOR PREPARING UNBLEACHED BIOMECHANICAL PULP FROM STRAW

BACKGROUND

Technical Field

The present invention relates to the technical field of paper technology and particularly to a method for preparing unbleached biomechanical pulp from straw.

Related Art

In 2016, pulp imports reached 21.06 million tons, and waste paper imports reached 28.5 million tons in China. The degree of dependence on the import of papermaking fiber raw materials was close to 50%. The large waste paper imports made up the deficiency in fiber raw materials in China and supported the development of the paper industry. In April 2017, the Central Government of China issued "The latest progress of prohibiting import the foreign waste, Progress on the implementation of the reform of the import management system for solid waste", which clearly stipulates that from the end of this year, China will ban the import of unsorted waste paper. In 2018, the total waste paper imports were 33% of 2017. By 2020, the import of waste paper will be prohibited in China. China is facing a shortage of about 26 million tons of papermaking raw materials every year. The shortage of resources in the traditional paper industry will be further highlighted. Development of new papermaking raw materials is imminent. To this end, the researchers make explorations on recyclable and renewable grass raw materials to find new papermaking raw materials.

In the traditional chemical pulping process, most of the hemicellulose in plant raw materials is degraded and dissolved in the pulping black liquor. The black liquor is usually treated by burning to recover heat energy and chemicals. Because the hemicellulose in the black liquor has a low heat of burning, treatment by burning it directly will not only cause the waste of energy, but also the consumption of very good biomass resources. At present, the most severe problem existing in the development of grass resources for pulping and papermaking is the pollution, which is also a critical problem caused by the presence of straw pulp and a key issue underlying whether the straw pulp can survive.

Therefore, the development of a low-pollution, low-energy-consumption, and high-quality pulping method suitable for straw pulp is a focus of research in the paper industry in China, and also a bottleneck that needs to be broken in the development of the industry.

The treatment of straw pulp by the degradation of biological enzymes and microorganisms is a hot area of research in biological pulping. Compared with the use of microorganisms, the use of enzymes to treat raw materials is of great advantage in the pulp and paper industry because they do not require sterilization and large fermentation space, and can specifically act on substrates. However, the current research on biological pulping with enzymatic pretreatment is mainly focused on chemical pulping and bleaching, and there are few reports on the use of enzymatic pre-treatment in producing high-yield pulp from and improving the pulping performance with wheat straw.

SUMMARY

In view of the above problems, the present invention provides a method for preparing unbleached biomechanical pulp from straw. Straw as raw material for pulping is treated with steam or hot water, then a small amount of alkali (NaOH or KOH) is added to adjust the pH to 10-14, the straw is softened by hydrothermal saturation, then the temperature of the straw is adjusted, alkaline compound enzymes are added for biological treatment, and finally the straw is refined, where the prepared mechanical pulp can meet the requirements of producing unbleached packaging paper and paper-based materials.

The following technical solutions are adopted in the present invention.

According to a first aspect of the present invention, a method for preparing an unbleached biomechanical pulp from straw is provided, which includes the following steps:

(1) cutting the physically selected dedusted air-dried straw into 3-6 cm long ready-to-use materials;

(2) transferring the ready-to-use materials to a treatment vessel or reactor at normal temperature, and treating with alkaline compound enzymes at a solid/liquid ratio of 1:4-1:8 W/V, where during the treatment, a small amount of alkali is added so that the straw is controlled to pH 7-10, and the treatment time is controlled to 30-90 min;

(3) removing the stalk treated in Step (2) and further treating with hot alkali water or steam at a temperature of 80-120° C.;

(4) refining the straw treated in Step (3) in one or more stages so that the beating degree is 25-55° SR;

(5) washing with water after refining to obtain a biomechanical pulp, where after washing the pulp, the water is treated with a multi-purpose evaporator, the solid residue is recovered for incineration in a boiler, and the heat energy is recovered for the treatment with hot water or steam in Step (1); and (6) defibrating the obtained biomechanical pulp by a defibrater and evenly mixing.

In a second aspect of the present invention, a mechanical pulp prepared by the method described above is provided.

In a third aspect of the present invention, use of the mechanical pulp described above in the preparation of unbleached packaging paper and paper-based materials is provided.

The present invention has the following beneficial effects.

In the present invention, straw is used as a raw material, which is treated with alkaline biological enzymes, heated with hot alkali steam, refined, and washed. In the present invention, when the refining is completed, the pH of the biomechanical pulp is close to neutral, and after washing the pulp, the water is treated with a multi-purpose evaporator, the solid residue is recovered for incineration in a boiler, and the heat energy is recovered for use in the pretreatment section with hot water. The whole production process does not need alkali recovery, thereby avoiding environmental pollution from the source. This technology conforms to the national industrial policy of resource conservation, economic recycling, energy saving and emission reduction. The present invention overcomes the problems of difficulty in recovering the alkali wastewater accompanying straw pulp and serious pollution in the prior art. This is of great significance for the industrial production of straw pulp and the development of the paper industry.

The method of the present invention is simple and has low requirements on the equipment, and is suitable for the production of various small and medium-sized paper-making enterprises.

The mechanical pulp prepared by the method of the present invention has significantly improved ring-crush strength, can be used to prepare corrugated paper or cardboard paper, and can significantly improve the compressive strength of the carton.

DETAILED DESCRIPTION

It should be noted that the following detailed description is exemplary and is intended to provide a further description of the present invention. All technical and scientific terms used herein have the same meaning as commonly understood by one of ordinary skill in the art to which this invention belongs, unless otherwise indicated.

It is to be noted that the terminology used herein is for the purpose of describing particular embodiments, and is not intended to limit the exemplary embodiments of the present invention. As used herein, the singular terms are also intended to include the plural, and it is also to be understood that when the terms "include" and/or "comprise" are used in the specification, they indicate the presence of features, steps, operations and/or combinations thereof, unless otherwise indicated.

In view of the problems raised in the background, in a first aspect, a method for preparing an unbleached biomechanical pulp from straw is provided, which comprises the following steps:

(1) cutting the physically selected dedusted air-dried straw into 3-6 cm long materials for use;

(2) transferring the ready-to-use materials to a treatment vessel or reactor at normal temperature, and treating with alkaline compound enzymes at a solid/liquid ratio of 1:4-1:8 W/V, where during the treatment, alkali is added so that the straw is controlled to pH 7-10, and the treatment time is controlled to 30-90 min;

(3) removing the stalk treated in Step (2) and further treating with hot alkali steam at a temperature of 100-120° C.;

(4) refining the straw treated in Step (3) in one or more stages so that the beating degree is 25-55° SR;

(5) washing with water after refining to obtain a biomechanical pulp, where after washing the pulp, the water is treated with a multi-purpose evaporator, the solid residue is recovered for incineration in a boiler, and the heat energy is recovered for the treatment with hot water or steam in Step (1); and (6) defibrating the obtained biomechanical pulp by a defibrater and evenly mixing.

In the present invention, straw is treated with alkaline biological enzymes, to degrade substances such as hemicellulose, lignin and pectin, and break and open the linkages between cellulose and hemicellulose and lignin. During the process of enzymatic treatment, a small amount of alkali is added to make the pH of the slurry alkaline, so the lignin can be quickly dissolved out. After treatment with alkaline biological enzymes, the straw is further treated with hot alkali steam. The hot alkali steam can fully swell and extract lignin and hemicellulose to further soften the straw pulp. At the same time, it reduces the damage to the fibers and ensures the pulp quality. The heating treatment with steam can completely inactivate the biological enzymes in the straw pulp and avoid the influence of the biological enzymes on subsequent pulping.

Further, the alkaline biological compound enzymes used in Step (2) are a compound enzyme of alkaline xylanase, alkaline cellulase, and alkaline pectinase, which is used in a total amount of 30-120 IU/mL. The ratio of enzyme activity of the alkaline xylanase, alkaline cellulase and alkaline pectinase is 8-12:3-5:1.5-3.

In the prior art, in order to protect the activity of biological enzymes, hot water or steam is often used to pre-treat the pulping raw materials, to dissolve out the metal ions in the material in large quantities, so the impact of metal ions on the biological enzyme activity is reduced. The alkaline biological compound enzymes of the present invention cooperate with each other and have a significant degradation effect. No treatment with hot water is needed, thereby ensuring the pulp yield.

Further, the amount of the alkali added in Step (2) is 0.5%-3%.

Further, the alkali used is NaOH or KOH.

Further, the treatment temperature in Step (2) is 45-60° C. Within this temperature range, the enzymatic hydrolysis efficiency is the highest.

Further, the treatment time with hot alkali vapor in Step (3) is 10-60 min. Within this treatment time range, components such as lignin and hemicellulose can be dissolved out, and reduction in pulp yield caused by a long treatment time is avoided.

Further, the pH of the hot alkali water in Step (3) is 9-14. The best effect is achieved by treatment with steam at such a pH.

Further, the straw is wheat straw.

In a second aspect of the present invention, a mechanical pulp prepared by the method described above is provided. The mechanical pulp obtained in the present invention not only has a high yield, but also has significantly improved tensile strength and ring-crush strength.

In a third aspect of the present invention, use of the mechanical pulp described above in the preparation of unbleached packaging paper and paper-based materials is provided.

The mechanical pulp of the present invention can be used for making packaging paper or paper-based materials, such as corrugated paper and cardboard paper. The mechanical pulp of the present invention has high ring-crush strength, and the carton prepared therewith has the advantage of strong compression resistance.

To enable those skilled in the art to more clearly understand the technical solutions of the present invention, the technical solutions of the present invention will be described in detail below in conjunction with specific examples.

The biological enzymes used are from Shandong Longcote Enzyme Preparation Co., Ltd. and Novozymes (China) Biotechnology Co., Ltd.

Example 1: Method for Preparing Unbleached Biomechanical Pulp from Wheat Straw The method comprises the following steps:

(1) The physically selected dedusted air-dried wheat straw was cut into 33 cm long ready-to-use materials.

(2) The ready-to-use materials were transferred to a treatment vessel or reactor at normal temperature, and treated with warm water and alkaline compound enzymes at a solid/liquid ratio of 1:5 kg/L, where during the treatment, NaOH is added to adjust the pH so that the water content of the wheat straw is 8, the treatment time is controlled to 90 min, the temperature is 50° C., the amount of enzymes used is 100 IU/mL, and the ratio of enzyme activity of alkaline xylanase, alkaline cellulase and alkaline pectinase is 8:3:1.5.

(3) The wheat straw treated in Step (2) was removed, and then the softened wheat straw was further treat with hot alkali steam with a pH value of 14 and a temperature of 110° C. for 60 min to dissolve out a part of hemicellulose, lignin, pectin and other substances.

(4) The wheat straw treated in Step (3) was refined in one or more stages so that the beating degree is 42° SR.

(5) The pulp was washed with water after refining to obtain a biomechanical pulp, where after washing the pulp, the water was treated with a multi-purpose evaporator, the solid residue was recovered for incineration in a boiler, and the heat energy was recovered for the treatment with hot water or steam in Step (1).

(6) The obtained biomechanical pulp was defibrated by a defibrater and evenly mixed.

The refined pulp was formed into unbleached corrugated paper at a density of 70 g/m$^2$, and the physical performances were tested. Each physical performance can meet the requirements of common unbleached corrugated paper. The performances are shown in Table 1 below.

Control method 1: The biological enzyme was acidic xylanase. The mixture of hot water and wheat straw in a reactor or treatment vessel was adjusted to pH 4.8 with 0.1 mol/L HAc-NaAC buffer. The temperature was 48° C., the treatment time was 120 min, and the enzyme dosage was 100 IU/mL, where the ratio of enzyme activity of acidic xylanase, acidic cellulase, and acidic pectinase was 8:3:1.5.

The other steps were the same as those in Example 1.

Control method 2: The treatment with biolobical enzymes was omitted, and the other steps were the same as those in Example 1.

The tensile property of the pulp was measured according to GB/T453-2002, the tearing resistance was measured according to GB/T455-2002; and the ring-crush strength was measured according to GB/T2679.8-1995. The indicators are shown in Table 1 below.

TABLE 1

Performance measurements of biomechanical pulp by various methods

| Method | Beating degree/° SR | Tensile property/ km/ | Tearing resistance/ mN · m$^2$ · g$^{-1}$ | Pulp yield % | Ring-crush strength |
|---|---|---|---|---|---|
| Example 1 | 42 | 3.17 | 3.56 | 85.2 | 12.12 |
| Control method 1 | 42 | 2.93 | 3.34 | 85.1 | 7.54 |
| Control method 2 | 42 | 2.98 | 3.16 | 86.9 | 8.26 |

Example 2: Method for Preparing Unbleached Biomechanical Pulp from Wheat Straw (1) The physically selected dedusted air-dried wheat straw was cut into 4 cm long ready-to-use materials.

(2) The ready-to-use materials were transferred to a treatment vessel or reactor at normal temperature, and treated with warm water and alkaline compound enzymes at a solid/liquid ratio of 1:4 kg/L, where during the treatment, NaOH is added to adjust the pH so that the water content of the wheat straw is 9, the treatment time is controlled to 60 min, the temperature is 55° C., the amount of enzymes used is 30 IU/mL, and the ratio of enzyme activity of alkaline xylanase, alkaline cellulase and alkaline pectinase is 12:5:3.

(3) The wheat straw treated in Step (2) was removed, and then the softened wheat straw was further treat with hot alkali steam with a pH value of 13 and a temperature of 120° C. for 10 min to dissolve out a part of hemicellulose, lignin, pectin and other substances.

(4) The wheat straw treated in Step (3) was refined in one or more stages so that the beating degree is 40° SR.

(5) The pulp was washed with water after refining to obtain a biomechanical pulp, where after washing the pulp, the water was treated with a multi-purpose evaporator, the solid residue was recovered for incineration in a boiler, and the heat energy was recovered for the treatment with hot water or steam in Step (1).

(6) The obtained biomechanical pulp was defibrated by a defibrater and evenly mixed.

The refined pulp was formed into unbleached corrugated paper at a density of 60 g/m$^2$, and the physical performances were tested. Each physical performance can meet the requirements of common unbleached corrugated paper. The performances are shown in Table 2 below.

Control method 1: The biological enzyme was xylanase. The mixture of hot water and wheat straw in a reactor or treatment vessel was adjusted to pH 4.8 with 0.1 mol/L HAc-NaAC buffer. The temperature was 48° C., the treatment time was 120 min, and the enzyme dosage was 30 IU/mL, where the ratio of enzyme activity of acidic xylanase, acidic cellulase, and acidic pectinase was 12:5:3.

The other steps were the same as those in Example 2.

Control method 2: The treatment with biolobical enzymes was omitted, and the other steps were the same as those in Example 2.

The tensile property of the pulp was measured according to GB/T453-2002, the tearing resistance was measured according to GB/T455-2002; and the ring-crush strength was measured according to GB/T2679.8-1995. The indicators are shown in Table 2 below.

TABLE 2

Performance measurements of biomechanical pulp by various methods

| Method | Beating degree/° SR | Tensile property/ km/ | Tearing resistance/ mN · m$^2$ · g$^{-1}$ | Pulp yield % | Ring-crush strength |
|---|---|---|---|---|---|
| Example 2 | 40 | 3.15 | 3.63 | 83.4 | 11.38 |
| Control method 1 | 40 | 2.74 | 3.38 | 82.9 | 7.59 |
| Control method 2 | 40 | 2.89 | 3.21 | 84.6 | 8.17 |

Example 3: Method for Preparing Unbleached Biomechanical Pulp from Wheat Straw (1) The physically selected dedusted air-dried wheat straw was cut into 5 cm long ready-to-use materials.

(2) The ready-to-use materials were transferred to a treatment vessel or reactor at normal temperature, and treated with warm water and alkaline compound enzymes at a solid/liquid ratio of 1:6 kg/L, where during the treatment, NaOH is added to adjust the pH so that the water content of the wheat straw is 8, the treatment time is controlled to 60 min, the temperature is 50° C., the amount of enzymes used is 80 IU/mL, and the ratio of enzyme activity of alkaline xylanase, alkaline cellulase and alkaline pectinase is 10:4:3.

(3) The wheat straw treated in Step (2) was removed, and then the softened wheat straw was further treat with hot alkali steam with a pH value of 12 and a temperature of 100° C. for 30 min to dissolve out a part of hemicellulose, lignin, pectin and other substances.

(4) The wheat straw treated in Step (3) was refined in one or more stages so that the beating degree is 38° SR.

(5) The pulp was washed with water after refining to obtain a biomechanical pulp, where after washing the pulp, the water was treated with a multi-purpose evaporator, the solid residue was recovered for incineration in a boiler, and the heat energy was recovered for the treatment with hot water or steam in Step (1).

(6) The obtained biomechanical pulp was defibrated by a defibrater and evenly mixed.

The refined pulp was formed into unbleached corrugated paper at a density of 80 g/m$^2$, and the physical performances were tested. Each physical performance can meet the requirements of common unbleached corrugated paper. The performances are shown in Table 3 below.

Control method 1: The biological enzyme was xylanase. The mixture of hot water and wheat straw in a reactor or treatment vessel was adjusted to pH 4.8 with 0.1 mol/L HAc-NaAC buffer. The temperature was 48° C., the treatment time was 120 min, and the enzyme dosage was 80 IU/mL, where the ratio of enzyme activity of acidic xylanase, acidic cellulase, and acidic pectinase was 10:4:3. The other steps were the same as those in Example 3.

Control method 2: The treatment with biolobical enzymes was omitted, and the other steps were the same as those in Example 3.

The tensile property of the pulp was measured according to GB/T453-2002, the tearing resistance was measured according to GB/T455-2002; and the ring-crush strength was measured according to GB/T2679.8-1995. The indicators are shown in Table 3 below.

TABLE 3

Performance measurements of biomechanical pulp by various methods

| Method | Beating degree/° SR | Tensile property/ km/ | Tearing resistance/ mN · m$^2$ · g$^{-1}$ | Pulp yield % | Ring-crush strength |
|---|---|---|---|---|---|
| Example 3 | 38 | 3.24 | 3.52 | 84.1 | 12.65 |
| Control method 1 | 38 | 2.97 | 3.26 | 83.7 | 7.83 |
| Control method 2 | 38 | 2.53 | 3.26 | 84.9 | 9.64 |

The above examples are preferred embodiments of the present invention, but the embodiments of the present invention are not limited to thereto. Any other changes, modifications, replacements, combinations, and simplifications may be made without departing from the spirit and scope of the present invention, which are all embraced in the scope of the present invention.

What is claimed is:

1. A method for preparing an unbleached biomechanical pulp from straw, comprising the following steps:

(1) cutting physically selected dedusted air-dried straw into 3-6 cm long pieces of straw;

(2) transferring the straw cut in Step (1) to a treatment vessel or reactor, and treating with one or more compound enzymes having activity under alkaline conditions at a solid/liquid ratio of 1:4-1:8 W/V, wherein during the treatment with the one or more compound enzymes, alkali is added so that the straw is controlled to pH 7-10, and the treatment time is controlled to 30-90 min;

(3) removing the straw treated in Step (2) and further treating with steam under alkaline conditions at a temperature of 100-120° C.;

(4) refining the straw treated in Step (3) in one or more stages so that a beating degree is 25-55° SR;

(5) washing with water after the refining to obtain a biomechanical pulp, after the washing, a filtrate containing the water is treated with a multi-purpose evaporator, and optionally (1) solid residue is recovered for incineration in a boiler and (2) heat energy is recovered for use in forming heated water or steam; and (6) defibrating the biomechanical pulp by a defibrater and evenly mixing.

2. The method according to claim 1, wherein the one or more compound enzymes used in Step (2) include a compound enzyme of alkaline xylanase, alkaline cellulase, and alkaline pectinase, wherein a ratio of enzyme activity of the alkaline xylanase, alkaline cellulase and alkaline pectinase is 8-12:3-5:1.5-3.

3. The method according to claim 1, wherein the amount of alkali added in Step (2) is 0.5%-3% by weight of a content of the treatment vessel or reactor.

4. The method according to claim 1, wherein the alkali is NaOH or KOH.

5. The method according to claim 1, wherein the treatment temperature in Step (2) is 45-60° C.

6. The method according to claim 1, wherein the treatment time with the steam in Step (3) is 10-60 min.

7. The method according to claim 1, wherein in the treatment with the steam in Step (3), the pH is 9-14.

8. The method according to claim 1, wherein the physically selected dedusted air-dried straw is physically selected dedusted air-dried wheat straw.

* * * * *